US007790975B2

(12) United States Patent
Eastwood et al.

(10) Patent No.: US 7,790,975 B2
(45) Date of Patent: Sep. 7, 2010

(54) SYNCHRONIZING A MUSICAL SCORE WITH A SOURCE OF TIME-BASED INFORMATION

(75) Inventors: Michael Eastwood, Biggleswade (GB); Paul Walmsley, London (GB)

(73) Assignee: Avid Technologies Europe Limited, England and Wales ( * ) Notice: Subject to any disclaimer, the term of this patent is extended or adjusted under 35 U.S.C. 154(b) by 535 days.

(21) Appl. No.: 11/821,805

(22) Filed: Jun. 26, 2007

(65) Prior Publication Data

US 2008/0011149 A1 Jan. 17, 2008

Related U.S. Application Data

(60) Provisional application No. 60/806,306, filed on Jun. 30, 2006.

(51) Int. Cl.
*G10H 1/40* (2006.01)
*G10H 7/00* (2006.01)

(52) U.S. Cl. ..... 84/611; 84/612

(58) Field of Classification Search ..... 84/611, 84/612, 635, 636
See application file for complete search history.

(56) References Cited

U.S. PATENT DOCUMENTS 5,920,025 A * 7/1999 Itoh et al. ..... 84/611
5,952,598 A * 9/1999 Goede ..... 84/609
5,962,802 A * 10/1999 Iizuka ..... 84/609
6,281,421 B1 * 8/2001 Kawaguchi ..... 84/603
6,307,141 B1 * 10/2001 Laroche et al. ..... 84/636
6,410,837 B2 * 6/2002 Tsutsumi ..... 84/604
6,653,545 B2 * 11/2003 Redmann et al. ..... 84/615
6,683,241 B2 * 1/2004 Wieder ..... 84/609
6,835,884 B2 * 12/2004 Iwamoto et al. ..... 84/609
7,078,607 B2 * 7/2006 Alferness ..... 84/609
7,214,869 B2 * 5/2007 Lee ..... 84/601
7,319,185 B1 * 1/2008 Wieder ..... 84/609
7,525,036 B2 * 4/2009 Shotwell et al. ..... 84/611
2002/0170415 A1 * 11/2002 Hruska et al. ..... 84/609
2003/0164084 A1 * 9/2003 Redmann et al. ..... 84/615
2003/0183065 A1 * 10/2003 Leach ..... 84/609
2007/0245883 A1 * 10/2007 Ball ..... 84/609

* cited by examiner

*Primary Examiner*—Jeffrey Donels
(74) *Attorney, Agent, or Firm*—Oliver Strimpel

(57) ABSTRACT

Disclosed is a method of synchronizing a musical score with a source of time-based information. The method comprises deriving a mapping between rhythmic positions associated with the musical score and a reference time base; and synchronizing the musical score and the source of time-based information using the derived mapping. The synchronization method can be used to synchronize the playback of a score with another source, such as a video clip.

27 Claims, 6 Drawing Sheets

SYNCHRONIZING A MUSICAL SCORE WITH A SOURCE OF TIME-BASED INFORMATION

CROSS REFERENCE TO RELATED APPLICATIONS

This application claims right of priority to and the benefit, under 35 USC §119(e), of prior filed provisional application Ser. No. 60/806,306, filed on Jun. 30, 2006. This application also is related to U.S. patent application entitled: Dynamically Generating Musical Parts From A Musical Score, filed on even date herewith, these applications are incorporated herein by reference.

BACKGROUND

The present invention relates to the editing and playback of music using a music editing application, in particular using musical notation.

Music notation software allows a user to enter and edit a musical piece using conventional music notation. Once a musical score has been completed, the software can be used to print the music for use in rehearsal or performance.

In performance of music for more than one player, each musician is typically given an extracted score consisting of only their music. Before the advent of music notation software, copyists would have to copy these parts by hand from the composer's score. The norm in notation software is to extract these parts, essentially into individual and independent scores. A considerable amount of work is necessary to update the layout and format of these extracted parts to make them usable by a performer. Additionally, if a composer or arranger wishes to make a change, either all the parts and score need to be changed separately, or the change needs to be applied to the score and a new set of parts copied or extracted, and all the formatting changes applied to each. The problem is compounded by the fact that there are some types of alteration to either the score or a part which need to be reflected in the other, and some types of change which need to be isolated to the context in which the change is made. Prior art music editing systems such as "Mosaic" and "Igor" have failed to adequately address these problems.

Music editing software is also increasingly used by educators, artists and composers to combine music with other media. The ability to integrate video with music notation could allow quick and easy creation of music for anything from short educational, art and promotional videos to television shows and feature films. However, unlike video, musical notation is not linear with respect to time, making this integration difficult.

The present invention seeks to alleviate some of these problems.

Accordingly, in a first aspect of the invention, there is provided a method of processing music data, comprising: storing score data providing a representation of a musical score; storing part data defining a musical part derived from the score, the part data including data specific to the part, wherein the score data and part data together form an accessible data representation of the part; and modifying or outputting the part by accessing the part representation.

In this way, a linked representation of the score and part can be provided, in which the score and part can be modified independently of each other. The part data thus preferably effectively provides a dynamic view of the score, containing only the relevant music for that part, modified in accordance with any part-specific data (e.g. layout information). Usefully, changes in the score may be reflected in the part, preferably unless overridden by corresponding data in the score. This can remove the need in many circumstances for performing part extraction, and can allow changes to be made to a score for which parts have been defined without the need to regenerate the parts. This is achieved by processing the part based on the part representation formed by the linked score data and part data. Part data for a plurality of parts may be stored.

The score data preferably comprises music content data defining musical notation elements, and the part-specific data preferably comprises part-specific layout data defining the layout of musical notation elements in the part. Thus the musical content of a part is preferably defined in the score, with the layout of the part defined in the part (or alternatively in both the part and score in combination). In this way, a single representation of the music content can be provided, ensuring consistency of music content across parts, whilst still providing the flexibility to refine the presentation or layout of that content for a given part or parts.

In a further aspect, the invention provides a method of generating output for one or more parts of a musical score using a music notation software program, comprising: inputting score data defining the musical score to the program; defining one or more dynamic views of the score, each view representing a musical part and specifying a portion of the score to be included in the part and layout data to be applied to the specified portion of the score when outputting the part; and generating output for a part from the score data using the dynamic view defined for the part.

By defining parts as dynamic views of the score, the need for part extraction can be removed in many circumstances.

In a further aspect of the invention, there is provided an interactive music editing application for editing a musical score, comprising: means for maintaining a representation of the score; means for maintaining a representation of one or more musical parts derived from the score; and a music editing interface including: a score editing view for displaying and editing the score; and a part editing view for displaying and editing a selected part; wherein the application is adapted to apply changes made in the score view to the score representation, and to distinguish, in the part editing view, between changes specific to the selected part and changes not specific to the selected part, and to apply the changes to the part representation or score representation accordingly.

This can give a user greater flexibility in editing scores and parts, allowing them to be edited in parallel. The score and part representations are preferably as set out above.

The invention further provides music data processing apparatus, comprising: memory means for storing score data providing a representation of a musical score; memory means for storing part data defining one or more musical parts derived from the score, the part data including data specific to the part or parts, wherein the score data and part data together form an accessible data representation of the part or parts; and processing means for processing the part or parts by accessing the part representation.

In a further aspect, the invention provides a method of synchronizing a musical score with a source of time-based information, comprising: deriving a mapping between rhythmic positions associated with the musical score and a reference time base; and synchronizing the musical score and the source of time-based information using the derived mapping.

In this way, time-based information, such as audio/visual data, can be synchronized more accurately with a musical score, which is typically defined against a non-linear, non-uniform, rhythm-based time base.

The mapping preferably maps tempo changes in the musical score to the reference time base. This can allow the mapping to be represented more efficiently. The mapping is preferably in the form of a table mapping rhythmic positions to timecodes, the table preferably comprising entries representing tempo changes in the musical score, each entry specifying the rhythmic position at which the tempo change occurs and the corresponding timecode. In this way, an efficient two-way mapping between rhythmic time and real time can be provided.

Synchronizing may comprise displaying a playback position indicator in the score corresponding to a current time position of the time-based data source. This can assist a composer in composing music which is to accompany the source.

The time-based data source preferably comprises media data, such as video data, and synchronizing the score with the time-based data source preferably comprises performing synchronous playback of the media data and the score, which can allow a composer to effectively review a composition intended to accompany media data.

In a further aspect, the invention provides a music notation software application comprising: a user interface for displaying and editing a musical score; a score playback component for playing back the score; a video playback component for playing a video source; and a synchronization component for synchronizing the score and the video source.

The invention also provides a media playback system for performing synchronous playback of a musical score with a video source, comprising: a processing component adapted to derive a mapping between rhythmic positions associated with the musical score and a reference time base; and a playback component adapted to synchronously play the score and video source using the derived mapping.

The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein.

The invention also provides a signal embodying a computer program for carrying out any of the methods described herein and/or for embodying any of the apparatus features described herein, a method of transmitting such a signal, and a computer product having an operating system which supports a computer program for carrying out any of the methods described herein and/or for embodying any of the apparatus features described herein.

The invention extends to methods and/or apparatus substantially as herein described with reference to the accompanying drawings.

Any feature in one aspect of the invention may be applied to other aspects of the invention, in any appropriate combination. In particular, method aspects may be applied to apparatus aspects, and vice versa.

Furthermore, features implemented in hardware may generally be implemented in software, and vice versa. Any reference to software and hardware features herein should be construed accordingly.

BRIEF DESCRIPTION OF THE DRAWINGS

Preferred features of the present invention will now be described, purely by way of example, with reference to the accompanying drawings, in which.

DETAILED DESCRIPTION

Figure 1:
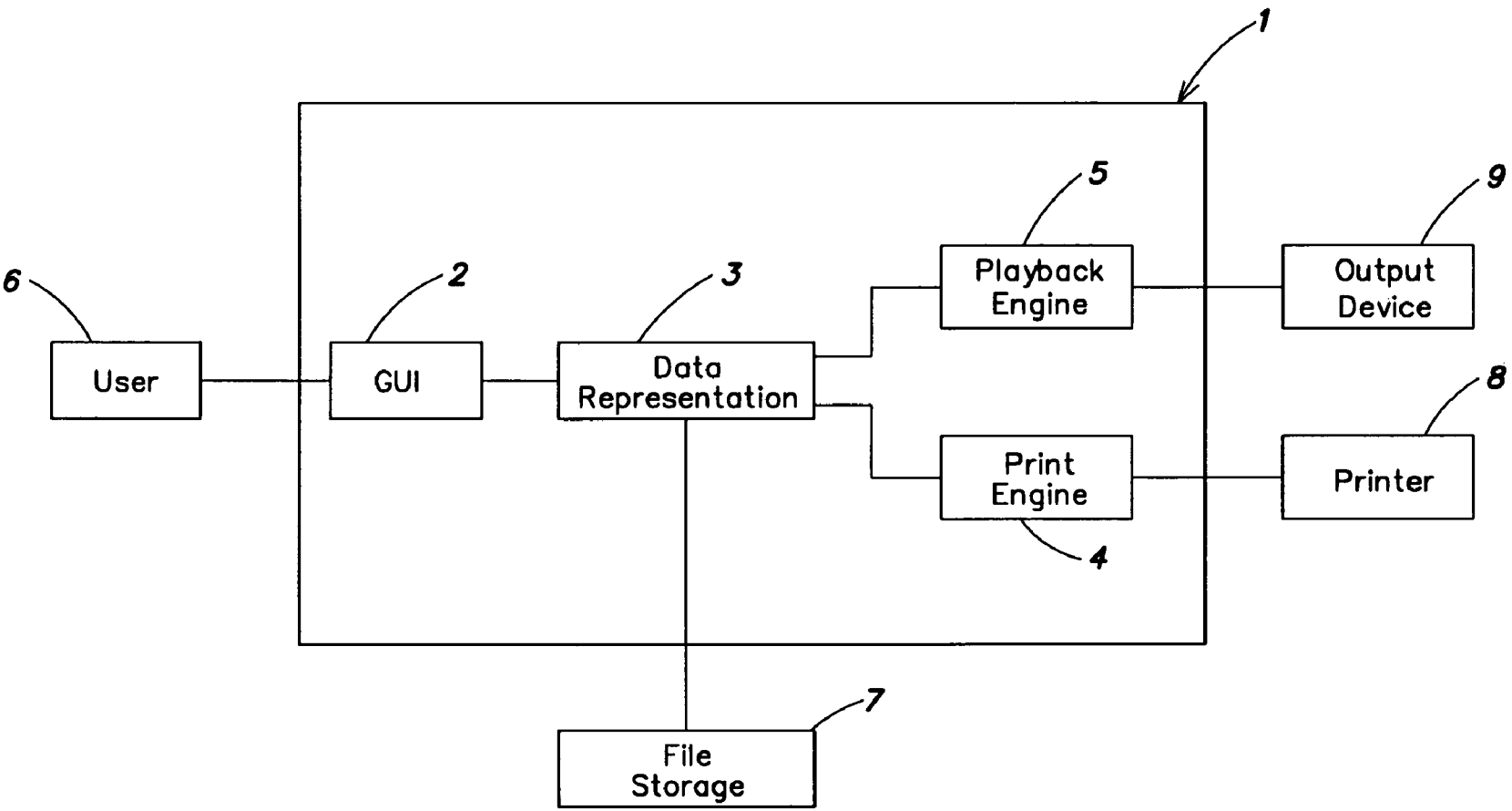
FIG. 1 illustrates a music editing application in overview.

Embodiments of the present invention may be implemented in the form of a music editing application. An example of a music editing application is illustrated in FIG. 1.

The music editing application 1 comprises several main components: a graphical user interface or GUI 2, an internal data representation 3, a printing component 4 and a playback engine 5.

GUI 2 allows for the entry and manipulation of music information by a user 6, typically using conventional music notation. Music notation is represented graphically on the screen and can be manipulated by the user using input devices such as a mouse and keyboard. The application 1 maintains an internal data representation 3 of the edited music, and the music data may be written to and read from file storage 7. Music data may also be imported into the internal representation from external sources. The printing component 4 allows for the edited music to be printed (typically again using conventional musical notation) to a printer 8. Playback engine 5 plays back the edited music to an audio output device 9, such as a soundcard, MIDI interface or audio recording device. Where music is synchronized with other media, such as video clips, the playback engine may also control video output to a monitor or video recording device.

Two main features of the music editing application will be described in detail below:

- A "Virtual Parts" feature which allows for the definition of parts which are dynamically linked to the underlying score.
- A "Media synchronization" feature which allows for the synchronization of a musical score with an external media source, such as video.

Virtual Parts

This feature allows the parts and score of a musical composition to be kept in step. The application provides the ability to make some elements of a part different from a score: for example, position of dynamics and other text, transposition changes. Sometimes these changes behave differently depending on where they are made: for example, dragging a dynamic in the score changes the note to which it is attached (and consequently updates the part), while dragging the dynamic in the part leaves the dynamic attached to the original note (the dynamic may change colour to indicate that it has been dragged).

Figure 2:
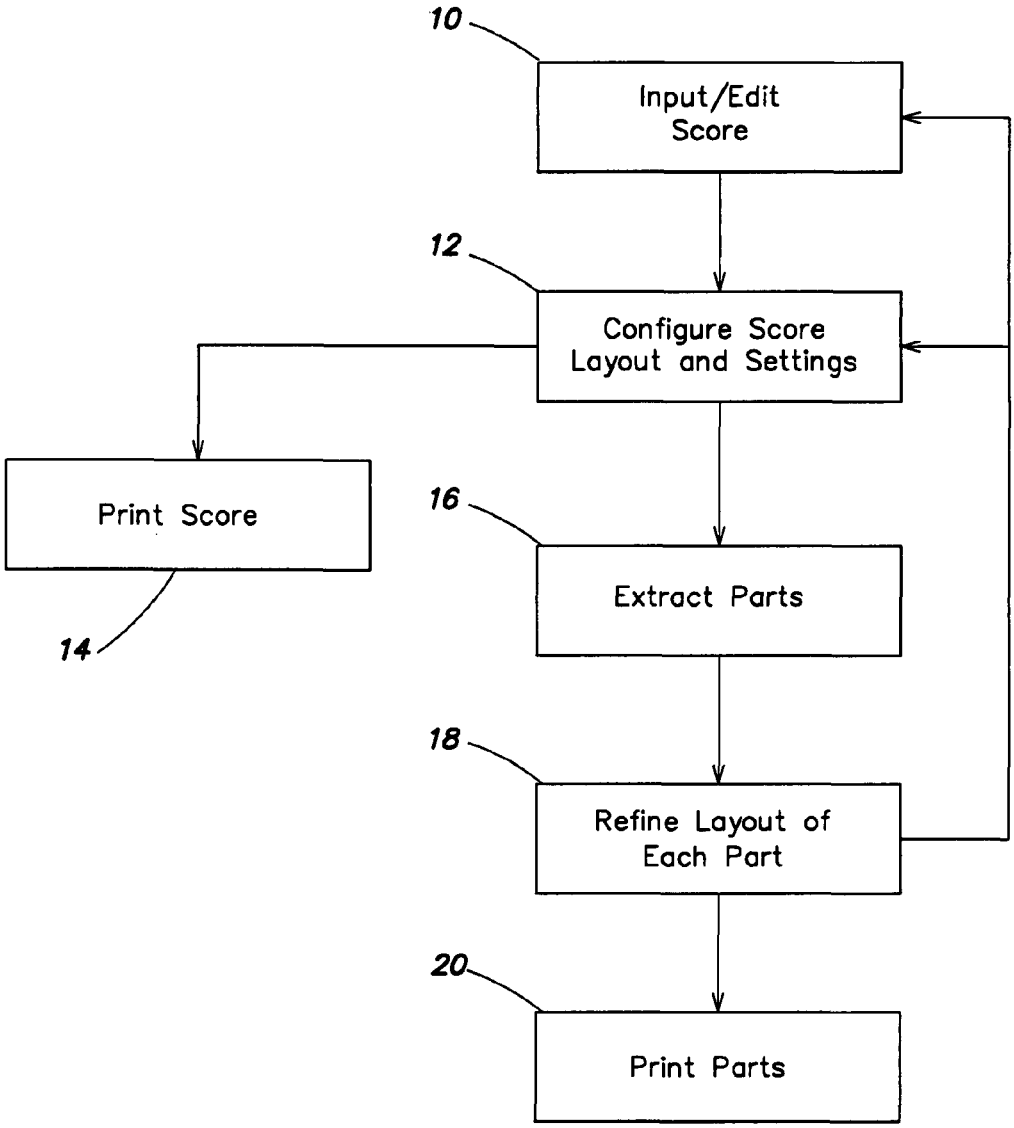
FIG. 2 illustrates a conventional method of editing and printing music.

FIG. 2 illustrates a conventional method of editing complex music and generating multi-part output, using a music editing application.

The user of the application inputs and edits the music for a musical piece at step 10, for example using a graphical user interface to specify notes, rests, durations, time signatures and keys, tempo indications, dynamics and the like. Alternatively or additionally, music may be imported from some external source, such as an external file in a music notation or MIDI format, or directly from a MIDI instrument.

The musical piece is set out in the form of a score, which may contain music for a variety of different instruments; for example, the score may include music for each instrument in an orchestra or a band. The user may specify general configuration settings and layout settings which are generally applicable to the score in step 12 and can then print the score at step 14. However, often a user will want to print the music for the various instruments separately by creating parts for each instrument (or group of instruments). To this end, the application provides functionality for extracting parts from a score.

The user extracts the required part or parts at step 16. After extraction, the parts are separate from the original score. The user may then refine the configuration and layout of each part separately at step 18, and print the parts at step 20. However, if after part extraction the user determines that changes are required to the music itself, or the generally applicable configuration and layout settings, the user must generally return to steps 10 or 12 and make those changes in the original score. After making the changes, the extraction of the parts at step 16 must then be repeated. Since part extraction can be a complex and time-consuming process, this approach can be inefficient. Additionally, any changes made to the part are lost if the user returns to editing the score and then re-extracts the parts.

Embodiments of the present invention address these problems by allowing parts to be defined as dynamic views on the underlying score. These dynamic views are referred to as "Virtual parts" and may be modified alongside the score itself.

A virtual part does not correspond to a fully extracted part but instead specifies the relationship or differences between the part and the underlying score. The information held in the virtual part is referred to herein as part-specific information. This typically includes layout-related information, since parts will usually have a different layout to the score. Importantly, a virtual part remains linked to the underlying score, with all part-independent information (such as the music itself and generally applicable layout and configuration settings) being specified in the score.

Figure 3:
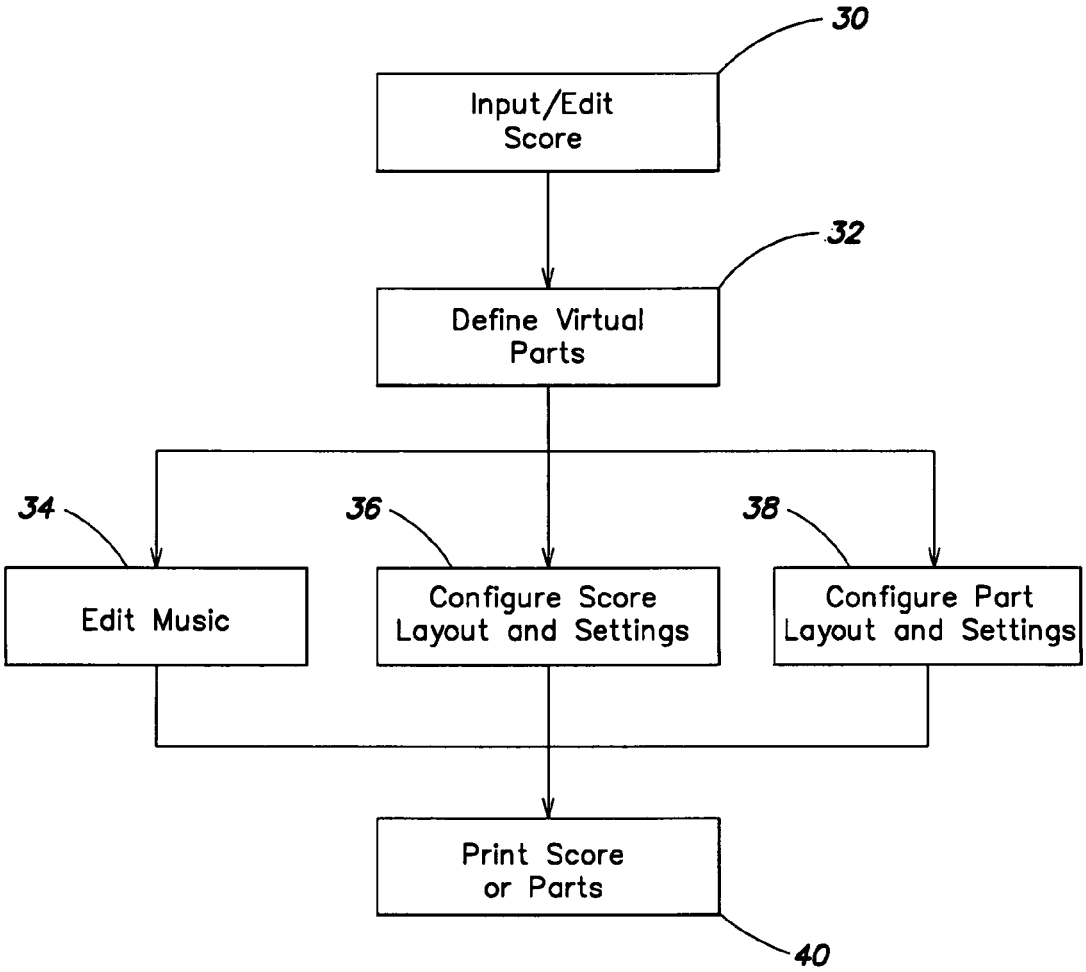
FIG. 3 illustrates a method of editing and printing music using Virtual Parts.

The process of editing music using virtual parts is illustrated in FIG. 3.

As before, the user starts the editing process by inputting or importing music data at step 30. During editing, the user may set up one or more virtual parts in step 32. These may also be configured automatically (for example by creating a virtual part for each instrument or group of related instruments). The automatic generation of virtual parts may be user-configurable.

Once virtual parts have been defined, the user may continue to edit the music content in step 34, configure score layout and settings in step 36 and configure part layout and settings in step 38. These may all be carried out in parallel.

The relationship between the virtual parts and the score is dynamic, meaning that, generally speaking, changes made to the score are automatically reflected in the corresponding parts. The need for extraction and re-extraction of parts as described above is thus removed.

A user may then print the entire score or one or more selected parts at step 40. When printing a virtual part, the music editing application selects the relevant information from the score (e.g. music for a particular instrument) and modifies the information (in particular layout information) based on any part-specific information specified in the virtual part.

Figure 4:
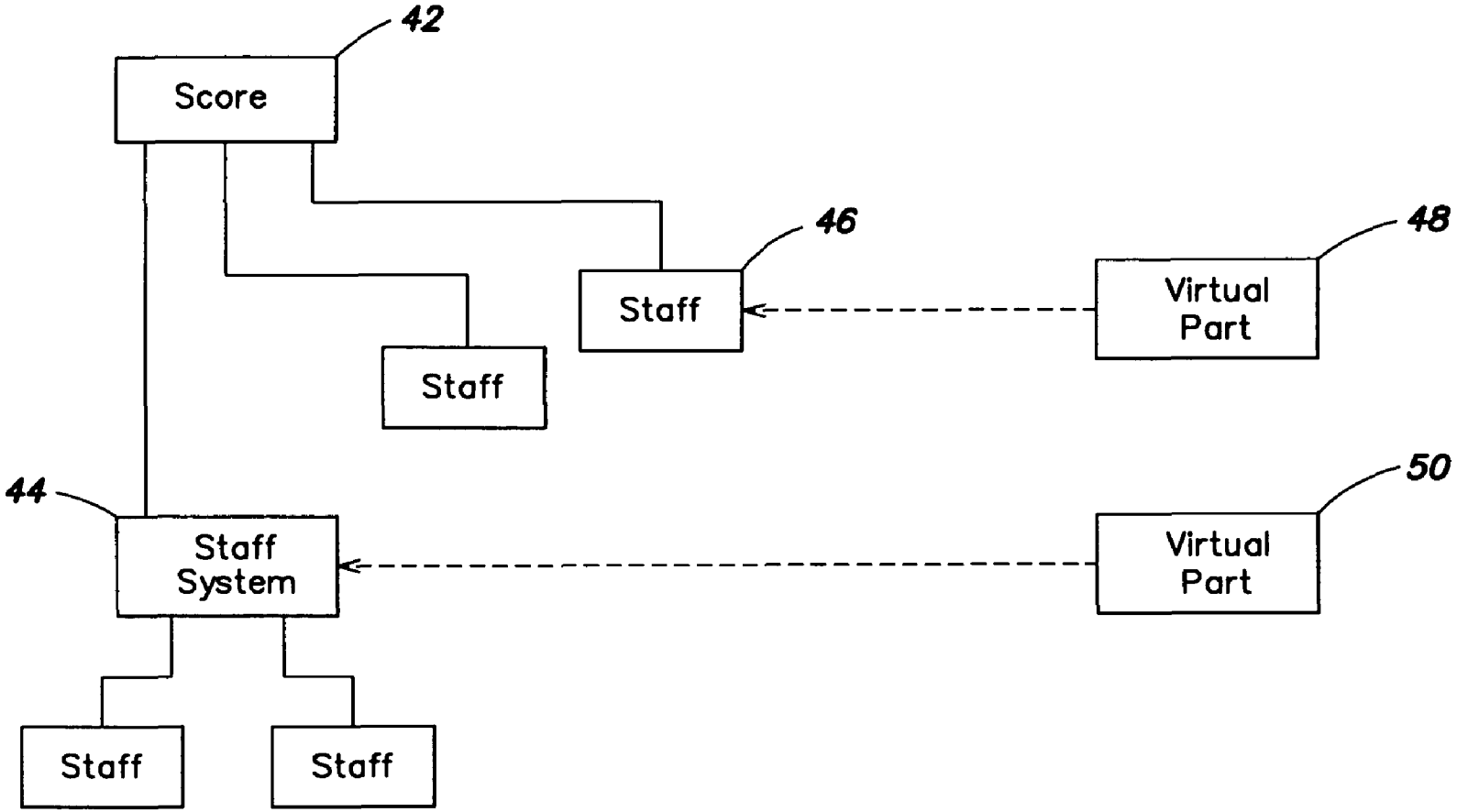
FIG. 4 illustrates the relationship between virtual parts and a score.

The relationship between scores and virtual parts will now be described in more detail with reference to FIG. 4.

A score 42 typically consists of one or usually more staves (e.g. 46). Staves may be grouped into staff systems, such as system 44. Individual staves or staff systems typically represent a single instrument.

Parts are usually produced (e.g. for rehearsal and performance purposes) for each instrument or group of related instruments and thus typically each contain only the staff or staves for the respective instruments. However, the music editing application preferably allows arbitrary selections and groupings of staves to be represented as virtual parts.

In the example shown, two virtual parts 48 and 50 are defined, with virtual part 48 corresponding to staff 46 and virtual part 50 relating to staff system 44. A virtual part may of course also relate to multiple staves/staff systems.

Scores, staves and other musical entities are represented in the internal data representation 3 (see FIG. 1).

The data representation preferably comprises a set of music objects each with a number of attributes. It should be noted that the term "object" is used here in a general rather than an object-oriented design sense. Objects may of course be implemented as objects in an object-oriented design, but other implementations are also possible.

For example, a "note" object may represent a note in the score and may include attributes such as "note value", "note duration", "layout position" and the like. Additionally, the "note" object may reference a "staff" object representing the staff on which the note is placed. In this way, the score may be efficiently represented as an object hierarchy.

Two types of attributes are preferably provided in music objects:

Attributes which can only be set for the score as a whole

Attributes which can be set either in the score or in a virtual part

The first type of attribute holds a single value, which is applicable to the score as a whole and cannot be changed in a part. Typical examples are attributes relating to the musical content, such as note values or durations.

The second type of attribute is implemented as a list or array so as to be capable of holding multiple values. The list or array includes a value for the score as a whole, as well as values for any virtual parts in which the attribute has been set. The score value can be considered as a default value for the attribute, which can be overridden in a virtual part by specifying a different value for that part.

Interface routines for accessing the music objects are preferably provided which select the appropriate attribute value to be returned or modified depending on whether the operation relates to the score or to a virtual part (this may be specified in a parameter passed to the interface routines). Where an attribute value is not (yet) specified for a given part, the interface routines preferably return the default score value for that attribute if the attribute is being read, but add a new attribute value for the given part if the attribute is being written. Once an attribute value has been specified for a virtual part, it overrides the default score value, and any changes to the score value will not affect the virtual part, since the interface routines always return the value for the relevant virtual part if present. However, an attribute value for a virtual part may be deleted from the value list of an attribute to thereby re-establish the link from the virtual part to the score for that attribute—subsequently, the default score value of that attribute will be returned whenever the virtual part is accessed.

Using this approach, the creation of a virtual part does not require the copying of any data from the score representation, as is required in conventional part extraction. Instead, a virtual part automatically inherits the score content and settings, and only differences specific to the part need to be explicitly recorded in the data representation.

The above provides an example of how an efficient data structure can be implemented which allows differentiation between score-related data and part-specific data. Other implementations are of course possible.

The detailed design of the data structures will depend on which information should be global to the score—i.e. unchangeable in the part—and which score data it should be possible to override locally in the part.

To achieve a workable design, it is necessary to consider the degrees of freedom and interrelatedness between a score and its derived parts. Some things are clear—generally speaking, the part should contain all the same notes as the score, and in the same order. But some aspects of the layout—for example, the position of dynamic markings and other annotations, and aspects of the layout such as system and page breaks—can differ. And there are some things which might appear in a part (such as multi-rests, in which a number of empty bars are collapsed into one notational element) which might appear quite differently in a score, or not at all. The data representation chosen should adequately support the types of discrepancy between the two, preferably without impacting on the application's performance too heavily.

Thus, in preferred embodiments, the musical content (including notes and note durations, tempo indications, dynamics and the like) is generally defined, within the data representation, in the score and cannot be changed in the part, whilst layout and formatting (including positioning of notes, dynamics and the like) can be defined either in the score or the part.

The application's user interface provides a score view for viewing and editing the entire score, and a part view for viewing and editing a selected part. All changes made in the score view (content and layout) are applied to the base score representation. Changes made in the part view, on the other hand, are made either to the score representation or to the virtual part, as appropriate. For example, if in the part view changes are made to the music content, these changes will be recorded in the base score representation. If changes are made to the layout or positioning of objects, these changes will only be applied to the current part, not to the score or other parts.

In either view, music may be edited by placing and rearranging notation objects and setting layout options. Notation objects may, for example, be moved in the interface by dragging with the mouse. The exact behaviour of the application, in particular in response to layout and formatting changes, may however differ for certain actions depending on whether changes are made to the score or part. An example of such differences will now be given.

In the score, notation objects (such as lines, symbols, text items) are attached to a given rhythmic position. In the score view, moving a notation object a short distance will only effect the layout. However, if the object is moved sufficiently far, it will be reattached to a new rhythmic position. In the part view, on the other hand, the user is only able to modify the layout, and dragging a notation object will therefore not change its reattachment point (as this would be a change in the music content—or in other words a change in the meaning of the musical notation rather than its layout). Where the layout is modified in the part, those settings override corresponding settings in the score. Subsequent changes in the score view to the layout of the given object will then no longer be reflected in the part view. However, the user interface preferably provides the option to explicitly reset an object position to that specified in the score.

As a specific example, to improve the layout of the music, the user may move individual notes in the score view (without changing the note value). Assuming the part view layout has not been modified, the corresponding part will be displayed using the note positions specified in the score.

Subsequently, the user may make adjustments to the positions of the notes in the part view. These changes will not affect the score but will only be recorded in the virtual part. The note positions specified for the part will then override the default positions specified by the score, and changes subsequently made in the score will no longer affect the note positions in the part.

The user interface preferably also provides dialog boxes for configuring general layout options (such as font sizes and the like) in both the part view and the score view, with score settings providing defaults which can be overridden for the selected part in the part view if required.

When displaying and/or printing parts, the application also applies automatic reformatting rules to the part, including where possible:

- positioning bars with rehearsal marks, key signature and time signature changes and double bars at the start of a line to ease reading
- finding good places for page turns and reformatting the part accordingly
- collapsing multiple bars rest into single multirests In many prior art systems, parts have existed completely independently of the full score. When extracting parts, separate files are often created for each part.

In the present system, parts preferably do not exist as separate files (not even as separate files that maintain some kind of relational link to another file). Instead, parts simply exist as different "views" on the score.

Full part extraction functionality (e.g. to a separate file) may still be provided alongside the "Virtual Part" functionality described herein. This may be implemented in a conventional manner independently of the definition of virtual parts. Alternatively, part extraction may be performed on the basis of any virtual parts that have been defined, incorporating into the output of the extracted part any layout or other changes made to the corresponding virtual part. In any case, after extraction, the relationship between the part and the score from which it is extracted will be lost, and any further edits that are made to the part will no longer be reflected in the score, and vice versa.

Media Synchronization

Music is often composed specifically to accompany moving images of some form—for example a motion picture or television production. Often, the composer will want certain visual events to coincide with musical events, for example to provide emphasis, or to match the moods of the music and film. To enable this, the music editing application described herein provides the ability to synchronize the score being edited with an external media source.

Video typically has a strictly sequential and uniform notion of time based on frames, unlike the more abstract symbolic representation provided my musical notation of a score. Unlike a video, a notated musical score is not a simple time-fixed stream of information: a score may include notations such as repeat marks, first- and second-time bar indications, da Capo (repeat from the beginning) and dal Segno (repeat from sign) indications and directions to replay music from distant points, which lead to a non-linear timeline; furthermore, pause indications over notes and tempo indications in the score may change the alignment of events in the score with "real" time as would be understood by the video. The timing of music in music notation is rhythmic, based on time signatures, bars and beats. Music notation software thus differs from music sequencing software, which typically presents a linear and uniform view of musical content.

The music editing application described herein addresses this problem by "unrolling" the core's symbolic representation into a timeline representation including absolute time information for notation elements and keeping this information synchronized with the score's notation, updating it as changes are made to the score. Thus, for example, in cases where a particular bar is played more than once, multiple timings are stored in the unrolled timeline. This unrolled timeline provides a structure onto which "hit points" can be attached, for synchronizing specific events in the video with notation events in the score.

Figure 5:
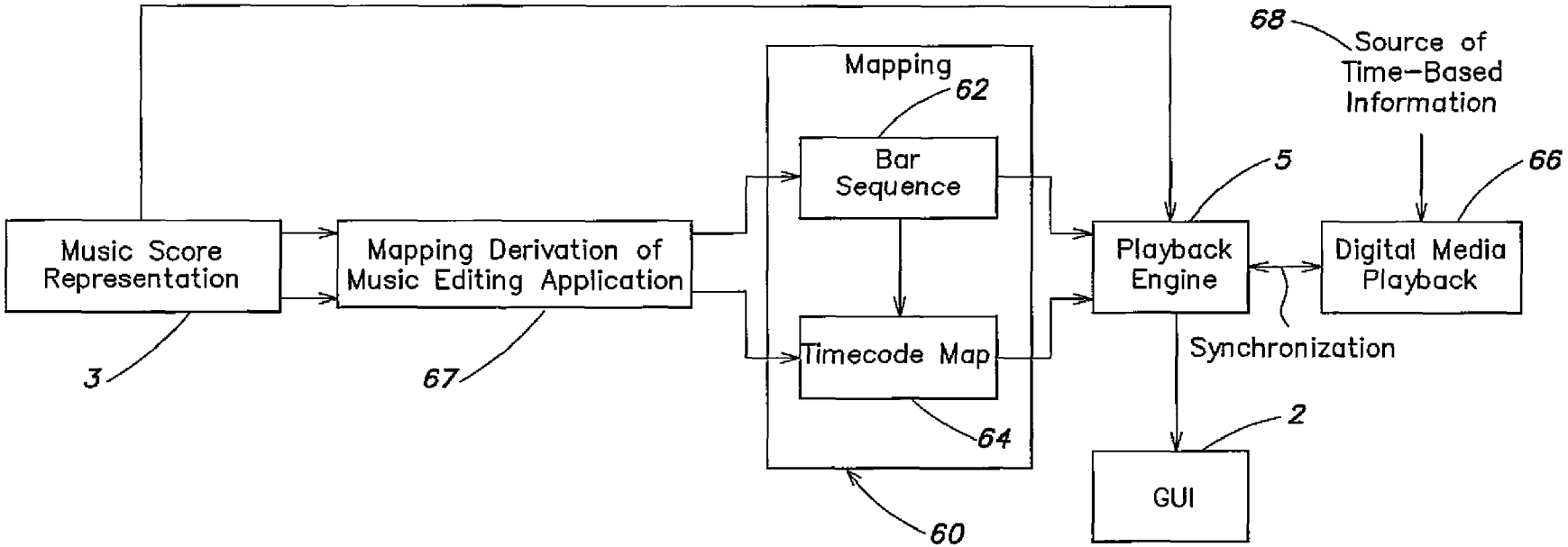
FIG. 5 illustrates synchronization between a score and an external media source.

The process is illustrated in overview in FIG. 5.

As mentioned above, the music editing application maintains an internal data representation 3 of the musical score being edited. This representation defines the music notation elements making up the score. Each element in the score is associated with a rhythmic position, which defines the time position of the element in the score in terms of the rhythm of the music (for example, a note may be positioned two beats into a four-beat bar). The rhythmic position alone, however, does not sufficiently specify the playback time of an element in real-time, as this depends on the time signature and tempo of the piece (both of which may change during a piece). Thus, the rhythmic timing recorded in the music notation is not uniform in real time, and, due to the possibility of repetition, not linear.

The music editing application 67 therefore derives a mapping 60 between the non-linear, non-uniform rhythmic timing of the musical score and linear real time as will now be described. For simplicity, the description assumes that this time mapping is derived for an existing score, for example once the user activates the synchronization feature. Once created, the music editing application then subsequently updates the mapping in response to changes made to the score. Alternatively, the time mapping may automatically be created with a new score and maintained in parallel with the score representation 3 as the score is changed.

The mapping 60 consists of two main parts, a bar sequence table 62 and a timecode map 64.

In a first step, the bar sequence table 62 is generated. The bar sequence table 62 provides a list of the bars in the score in the order of playback, repeating any bars as specified in the score. Thus, a bar which according to the score notation is to be repeated will appear multiple times in the bar sequence table 62, in the correct playback position. For example, where the musical score notation as recorded in the representation 3 specifies a group of two bars to be repeated, e.g.:

||: Bar A|Bar B :|| where "||:" and ":||" represent repeat marks, the "unrolled" bar sequence would be as follows:

Bar A, Bar B, Bar A, Bar B

For each bar in the bar sequence, a playback score position is calculated. This is expressed as a rhythmic position as described above but defines the time (in rhythmic terms) at which the bar is played back rather than the position at which it appears in the music notation. Thus, a repeated bar, having a single notational position, will have multiple playback positions. In the above example, assuming 4 beats per bar, the notational positions of Bar A and Bar B may be 0 and 4 respectively, whilst the playback positions recorded in the bar sequence table would be:

Bar A (0), Bar B (4), Bar A (8), Bar B (12)

Since the relative score positions of music objects within bars are not affected by repetitions of bars, the playback position of any given object (e.g. a note) can be determined by adding the score position offset of the object in the original bar to the playback position calculated for that bar.

The bar sequence table thus establishes a linear time line for the musical piece. However, this time line is still rhythmic, rather than real-time.

In a second step, a timecode map 64 is therefore created which provides a mapping between the (rhythmic) playback positions and real time, taking account of the tempo of the music and any tempo changes occurring during the music. Though it would, of course, be possible, to generate a table listing a corresponding real time value for each possible playback position (i.e. each rhythmic position), this would generally be inefficient, since the resulting table would be very large (in preferred embodiments the rhythmic positions use a time resolution of 1/256 quarter notes which would mean 1024 possible positions in a single 4/4 bar). Additionally, large parts of the table would have to be recalculated whenever tempo changes are applied to the score.

The music editing application therefore instead generates a timecode mapping table in which only moments where a tempo change occurs are explicitly mapped from their playback position to a real time value. For other playback positions not explicitly mapped in the table, the application then uses the real time value of the last preceding tempo change together with the currently applicable tempo to dynamically calculate a corresponding real time value.

However, tempo changes are not always abrupt but can instead be gradual—that is to say, a tempo change may be spread across multiple rhythmic time positions. Furthermore, tempo indications may be expressed in relative terms. To generate the timecode map 64, it is therefore necessary to accurately identify tempo changes at the rhythmic time resolution used to specify playback positions in bar sequence table 62.

To achieve this, the music editing application preferably plays the entire score silently via the playback engine 5, which is configured to produce a MIDI output stream. The tempo changes can then be extracted from the MIDI data stream.

For each tempo change identified, the corresponding playback position is determined (also from the MIDI data). An entry is then added to the timecode map 64, including:

The (rhythmic) playback position

The new tempo

A timecode

The timecode specifies the total elapsed time (in real time) since the start of the piece. This is preferably calculated by adding the time elapsed since the preceding tempo change to the timecode of the preceding tempo change (as recorded in the timecode map). The time elapsed since the last tempo change can in turn be calculated by dividing the number of rhythmic units played since the preceding tempo change by the tempo applicable since the preceding tempo change.

As an example, a tempo change occurs at time X. The last preceding tempo change, as recorded in the table, occurred at 1:20 (minutes:seconds) absolute time. At that point the tempo was changed to 180 beats per minute, and 90 beats of music have been played since then. The duration of those 90 beats is 90 beats divided by 180 beats/min=30 seconds; and X=1:20+0:30=1:50. Thus the timecode (X) for the new tempo change is recorded as 1:50.

In summary, the resulting timecode map 64 thus lists each tempo change that occurs during the music as a tuple of (playback position, tempo, timecode). The timecode map will typically also include an entry representing the start of the music, with position "0", timecode "0", and the starting tempo.

Together, the timecode map 64 and the bar sequence 62 provide a complete two-way mapping 60 between the music score representation 3 and a real-time time line (as defined by the timecodes), thereby allowing synchronization at arbitrary points in the score.

Specifically, once created, the mapping 60 can be used as follows.

To obtain the timecode for a given notational score position, the bar in which that position occurs is first determined, and the offset between the given position and the start of the bar is calculated. A lookup is then performed in the bar sequence table 62 to identify the playback position(s) of that bar. If the bar is repeated, this will result in multiple playback positions, one for each repetition of the bar. The calculated offset is then added to the position or to each position, resulting in one or more playback positions corresponding to the notational score position.

Next, for each playback position, the timecode map 64 is searched to identify the last tempo change immediately preceding the given playback position, by comparing the playback positions for the tempo changes in the table to the given playback position. The difference between the playback position of the immediately preceding tempo change and the given playback position then gives the amount of time in rhythmic terms between the given playback position and the preceding tempo change. From this, the actual real time elapsed can be determined as already described above (by dividing rhythmic time by tempo), and this value is then added to the timecode of the preceding tempo change to obtain the timecode corresponding to the given playback position. Multiple timecodes will be calculated where there are multiple playback positions, i.e. for repeated bars.

Conversely, to identify the playback position and notational score position corresponding to a given time code, the inverse of the above-described mapping operation is performed: the immediately preceding tempo change is determined from timecode map 64 by comparing time codes; the rhythmic time difference is calculated from the real time difference between time codes using the specified tempo to obtain the playback position corresponding to the given timecode; and the resulting playback position is looked up in bar sequence table 62 to determine the corresponding bar and hence notational score position.

The above-described mapping can be used to provide a variety of synchronization functionality and in particular allows synchronization of the score with an external media source as will now be described.

During playback of the score by playback engine 5, the mapping 60 is used to synchronize playback of the score with playback of external media by a digital media playback component 66 (which may be a software media player). The bar sequence table 62 also provides the playback sequence for the playback engine.

To achieve synchronized playback, a user preferably specifies the external media source 68 to be synchronized with the score, and the point in the score at which playback of the media source is to commence. At the specified point, the playback engine 5 then triggers playback of the media source by playback component 66.

Additionally, to correct for playback drift between the score and the media source, after playback has started the playback engine preferably periodically checks whether the score and media source are still synchronous by comparing the current time code of the media source reported by the digital media playback component to the current time code of the score as determined by the mapping 60. If these differ, the playback engine may force resynchronization by sending a correction command to the playback component 66 to instruct the component to continue playback at the correct timecode. Preferably, the playback engine will force resynchronization only if the timecode difference between the media source and the score exceeds a certain threshold. Resynchronization is performed at regular intervals (which may be user-configurable). Resynchronization is also performed if the user uses playback controls to stop, restart, fast forward, rewind or move to a specific location in the score.

The user interface 2 of the editing application preferably also uses the mapping to display a playback position indicator in the on-screen graphical representation of the score. This may, for example, be in the form of a vertical line which is displayed at the current playback position and is moved as playback progresses or if playback controls are used. Additionally, the user interface may display a timeline and/or timecodes above or below staves in the graphical view of the score (for example displaying time codes once every n bars).

As mentioned above, in the common example where music is composed for a film or television production, the composer will generally wish to ensure that the music fits the video source—for example that mood changes occur at the correct time of the film (such as a scene change) or to use musical events to emphasise on-screen events.

To assist the composer, the music editing application preferably allows the user to define event markers for the video (or other media) source. To this end, the application allows an event marker to be specified by entering a video timecode specifying the relevant location in the video clip, or by marking the location during playback of the video, for example by clicking a button at the time of the event. The timecode of the frame displayed at that point is then used as the event marker (adjustment may need to be performed to account for differences in the time base used by the video source and timecode map respectively). To allow accurate setting of event markers, the interface may provide pause and frame-by-frame navigation controls for controlling media playback. Event markers are also referred to herein as "hit points".

Once an event marker or hit point has been set at a given timecode, the corresponding position in the score is determined using the mapping 60, and an indication identifying the hit point is displayed at that position in the score. The indication may, for example, include the video time code and an event name provided by the user (e.g. "door opens") to allow the composer to identify the video event represented by the hit point. The composer can then use that information to adjust the musical composition to achieve the desired effect. For example, if dramatic music is intended to accompany the "door opens" event, then the composer may lengthen or shorten any preceding music to ensure that the dramatic music and on-screen event coincide. After changing the composition, the user can use the synchronized playback function described above to check whether the intended result has been achieved.

In the above examples, the external media source being synchronized with the score is digital video. However, the synchronization mechanism may also be used to synchronize the score with other media sources, such as animation data or a separate audio source, or indeed with any other kind of time-based information. For example, the score could be synchronized with time-based control information for an external system or device, such as a lighting system for a light show or theatrical show.

In the above examples, synchronization between the score and external source is used to force the external media source to follow the playback of the score. However, since the bar sequence 62 and timecode map 64 provide a two-way mapping between the score and absolute timecodes (absolute here means absolute within but relative to the score, not necessarily absolute in real time), this feature may similarly be used to force the score to keep in step with the external source, with tempo changes being applied to the score, or sections of the score being repeated or skipped, to achieve the required synchronization. This synchronization mode may, for example, be applicable to the synchronization of a musical score with an external source in which the sequence or duration of events is not predetermined, as for example in interactive media or video games.

Figure 6:
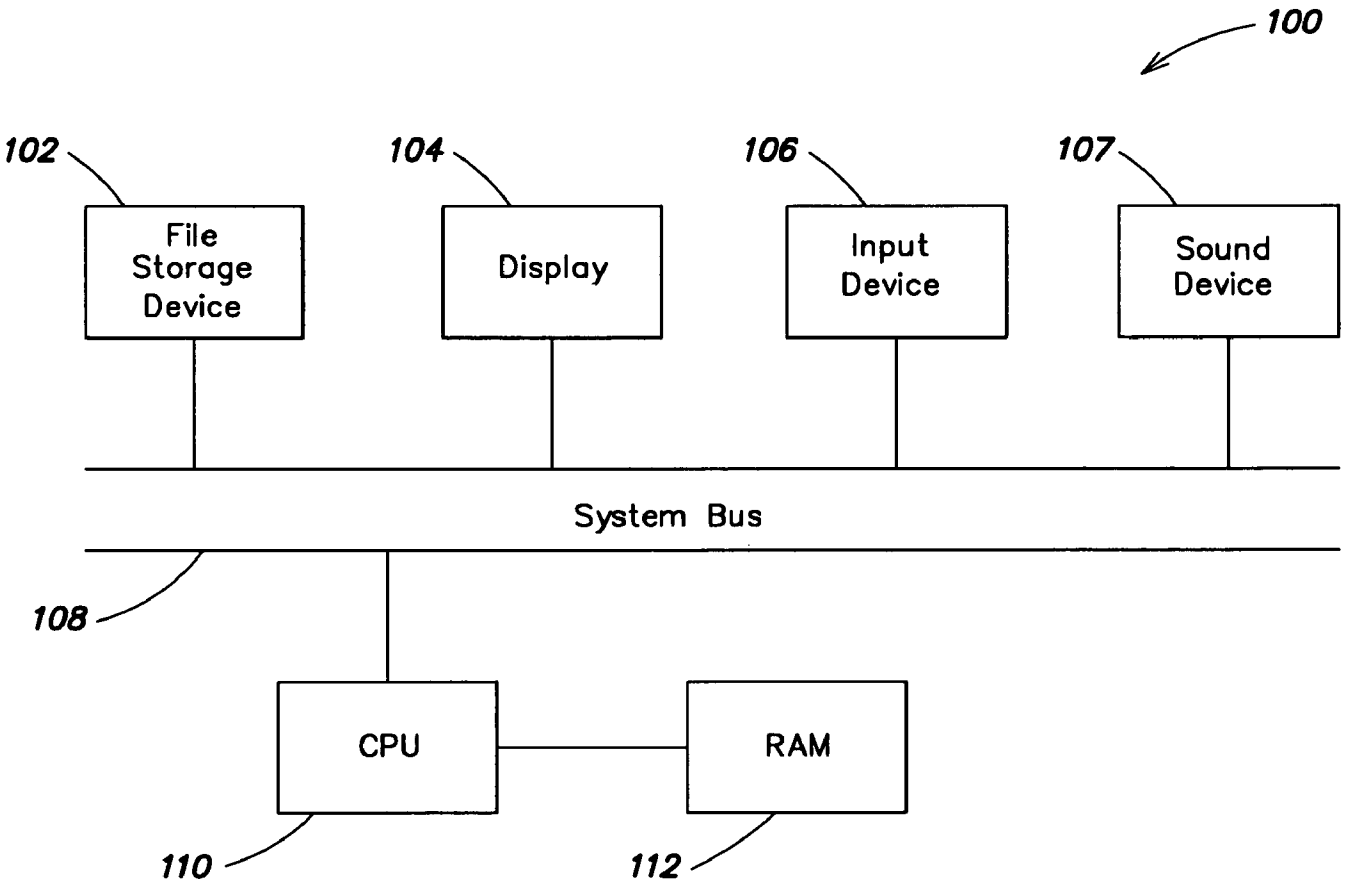
FIG. 6 shows in overview the architecture of a computer system for use with a music editing application.

The present invention may be implemented as computer software for execution on a general purpose computer system. Features may also be implemented by dedicated processing circuitry, or as a combination of hardware and software. An example of a computer system for use with a software implementation of the present invention is illustrated in FIG. 6.

The computer system 100 comprises a central processing unit (CPU) or processor 110 connected to a Random Access Memory (RAM) 112 via a memory bus, and to a system bus 108. The memory 112 may alternatively or additionally be connected directly to system bus 108. Also connected to the system bus 108 are a file storage device 102 (such as a hard disk drive), a display 104 and one or more input devices 106 (such as a keyboard and/or mouse).

Executable program code embodying the invention may be stored in file storage device 102 and is loaded into memory 112 on startup of the program, from where it is executed by processor 110. The program is typically in the form of an application having a graphical user interface displayed on display 104. An operating system is typically provided on the computer system to provide an environment for execution of the application, and to manage the computer system and associated peripheral devices. A sound device 107 (such as a sound card or MIDI interface) is also connected to the system bus 108.

Source data, such as musical scores, MIDI files and video files, are also stored in file storage device 102. Under control of the program executing on processor 110, the source data is loaded into memory 112 and operated on by the program, typically under control of the user, for example to edit a musical score. After editing, the score may be stored back in file storage device 102. The user may also print a score or part on a connected printer (not shown), or play back a score or part via sound device 107 (possibly synchronized with a video file displayed on display 104).

Example Implementation—Virtual Darts

An exemplary implementation of a music editing application incorporating "Virtual Parts" functionality as described above will now be described, with particular focus on user interface features of such an application.

In this description, parts that exist as a view of a particular staff or staves in the score are referred to as Virtual Parts, and parts that exist as an independent file are referred to as extracted parts.

Editing Parts

The possible edits that need to be made to instrumental parts typically fall into one of four categories:

- Edits that affect both the part and the score (e.g. adding or deleting a note, adding or deleting a bar, adding or deleting a text item, etc.)
- Edits that are possible in the part without affecting the score (e.g. adding or deleting a system break, changing page or staff size, changing staff spacing, etc.)
- Edits that happen automatically in the part without needing editing (e.g. switching on multirests, adding the instrument name to the top of the first page and as a header on subsequent pages, etc.)
- Edits that are sufficiently complex that they will force the user to extract a part rather than edit a Virtual Part (e.g. scores in which an instrument is split across multiple staves, etc.).

The user will generally create and edit parts after the majority of score preparation has been completed. This means that the user will generally want changes made in the score to affect the part, but that the reverse will not necessarily be true.

Making any edit in the score, then creating a part, has the same effect as creating the part, then making the same edit in the score.

User interface

In addition to conventional music editing features, the interface may provide the following dialogs and windows:

- Virtual Parts (floating window)
- New Part/Staves in Part (modal dialog)
- Part Appearance (tabbed modal dialog)
- Extract Parts (modal dialog)

Other user interface elements may also be provided (e.g. a combo box on the main toolbar for switching between parts).

The Virtual Parts Window

The Virtual Parts window allows you to:

- Create a default set of Virtual Parts if none have yet been created
- See a list of all the Virtual Parts in your score (including their name, how many staves each contains, and how many copies you want printed by default)
- View one or more Virtual Parts
- Create and edit existing Virtual Parts
- Extract Virtual Parts into separate files
- Print one or more Virtual Parts (including printing multiple copies of each part)

The list of Virtual Parts displayed includes:

- Name column: This is the name of the part, preferably created automatically from the corresponding instrument name when a part is created.
- Copies column: This is the number of copies that will be printed by default if the user clicks Print, and can be changed either by double-clicking and typing a new one, or using a spin control (paddles).

The following buttons may be provided in the window:

- Print button: This launches the Print dialog. This button is only enabled when one or more parts exist for that score, and when one or more parts is/are selected.
- Multiple Part Appearance button: This launches the Multiple Part Appearance dialog. The Appearance button is only enabled if you have at least one part selected
- New Part: This launches the New Virtual Part dialog. The New button is always enabled.
- Staves In Part: This launches the Staves In Part dialog. The Staves In Part button is only enabled if one part is selected in the list control.
- Delete Part: This displays an "Are you sure?"-type Yes/No/Cancel dialog. If the user clicks Yes, the application deletes the selected part(s). The Delete Part button is only enabled if one or more parts is/are selected in the list control.
- Extract Parts: This launches the Extract Parts dialog. This button is only enabled when one or more parts exist for that score.

The user can perform operations on multiple parts simply by selecting items in the list (using Shift-click to select a continuous range of parts, or Ctrl+click to select one or more parts), then clicking the desired button.

The list view control will also display the part whose window is currently active by selecting it in the list.

When the user clicks Extract in the Virtual Parts window, the application should warn the user about what they're about to do, popping up a Yes/No/Not Again dialog, e.g. "Extracting parts from your score will create a separate file for each part. Changes made to extracted parts are not reflected in the score, and vice versa. To maintain the changes, you should View your parts, not Extract them. Do you want to continue?" If the user clicks Yes, the Extract Parts dialog is shown. If the user clicks No, he is returned to the Virtual Parts window. The user can also choose to suppress this warning message in future by switching on the "Don't say this again" checkbox (the warning can then be reinstated by clicking the Show all warning messages button in the Preferences dialog).

The Virtual Parts window orders the list of Virtual Parts as follows:

Virtual Parts with the top staff that is highest in the order of staves in the score are listed first. "Top staff" here is the staff in the Virtual Part which appears nearest the top in the score (also taking into account any staff ordering changes the user has made in the Instruments and Staves dialog).

For Virtual Parts with the same "top staff," the Virtual Part with the greater number of staves is put first in the list. This is so a Virtual Part that happens to contain all the staves (a non-transposing score for example) is listed at the top of the list.

For Virtual Parts that are still indistinguishable after following these two principles, the order is effectively random.

New Part/Staves in Part dialog

The creation and editing of Virtual Parts is handled by these two dialogs.

The Staves in Part dialog is the same when triggered via the New or Edit button, except for the dialog's title bar, which says New Part for new parts and Staves in Part: [partname] if you are editing a part. The dialog displays two lists of staves: those available for inclusion (but not included) in the part and those selected for inclusion in the part. Buttons are provided for moving staves between the lists to thereby define which staves are to be included in the part.

When the dialog is launched for creating a new Virtual Part, the "Staves in part" list is empty, and every staff in the score is listed in the "Staves available" list.

When the dialog is launched for editing an existing Virtual Part, the "Staves in part" list contains the staves currently in the part, and those staves are therefore not listed in the "Staves available" list. The Staves available list uses the instrument name from the score when the user is creating a new Virtual Part, and uses the instrument name from the selected Virtual Part (if different from the score) when the user is editing an existing Virtual Part.

To add a staff or staves to a part, select it/them in the "Staves available" list and click Add to Part, or double-click it/them. The staff or staves are then removed from the "Staves available" list and added to the "Staves in part" list. The staff order of the score is initially retained in the "Staves in part" list. The Add to Part button is disabled if no staff has been selected in the relevant list.

If the user selects one staff of a multi-staff instrument and clicks Add to Part, all the staves in the instrument are added to the part. However, if the user requires only one or some of the staves in an instrument to be in a part—because he has used the "extra staff above/below" feature to create, say, a second flute, which needs its own part—he can remove staves individually from the Staves in part list.

To remove a staff or staves from a part, select it/them in the Staves in part list and click Remove from Part, or double-click it/them. The staff or staves are then removed from the "Staves in part" list and reinserted into the "Staves available" list, again respecting the staff order of the score. The Remove from Part button is disabled if no staff has been selected in the relevant list.

If the user removes all staves when editing a part and clicks OK, a message pops up: "Removing all staves from this part will delete it. Do you want to continue?" If the user clicks Yes, the part is deleted. If the user clicks No, the Edit Virtual Part dialog remains open and the user can add staves to the part.

Printing Virtual Parts

Virtual Parts can be printed in two ways:

When viewing a Virtual Part, choosing File>Print will print just that part.

When using the Virtual Parts window, clicking the Print button will print the selected part or parts.

In either case, the Copies field in the Print dialog will default to the number of copies chosen in the Virtual Parts window.

If multiple parts are selected and the number of copies differs between those parts, the Copies field in the Print dialog will show "-" (or blank) to signify that they differ. If the user changes the number of copies, it overrides the setting for each part and simply prints that many copies of all parts.

In addition, a File>Print All Parts menu item is provided in addition to the Print item. This option is always enabled if a score is open. If the score has no Virtual Parts, choosing this menu item produces an OK message box: "You need to create parts before you can print them. Choose Window>Virtual Parts and click New." If the score has Virtual Parts, choosing this menu item does the same as choosing all the parts in the Virtual Parts window and clicking Print, i.e. it prints all the parts in that score, regardless of the current selection in the Virtual Parts window.

When the user is printing more than one part at a time, it will usually not make sense for some parts to be printed (say) even pages only, others to be printed as booklets, some to be printed on A3 paper and others to be printed on A4 paper. So if the user is printing multiple parts, all the options in the Print dialog (with the exception of the number of copies) default to standard settings.

If the user then changes any of these values in the dialog, they apply to all the parts to be printed, but do not change the settings in each individual part—in other words, these settings are used once, and then thrown away.

The Extract Parts Dialog

The Extract Parts dialog allows the user to extract Virtual Parts into separate scores.

The dialog provides a list of Virtual Parts that have been created for the score (not a list of staves in the score). When the dialog is launched for the first time, all parts are chosen in this list box. The user can add or remove items from the selection in the normal way (using Ctrl+click or Shift-click).

When the user clicks OK to confirm the extraction, the application saves the list of parts selected in the dialog in the score, and when the dialog is subsequently re-opened, the list is initialized to these values, rather than to the selection in the Virtual Parts window: this is because the user will typically need to extract the same parts for a score, and they will typically always be the same few parts.

The filename format and folder chosen in the Extract Parts dialog is sticky per-session, per-score. A "Save to folder" control is provided which defaults to the folder in which the score itself from which the parts are extracted is saved.

Extracted parts are always saved to the chosen folder, but the user can choose to view the part after saving it by switching on a "View parts now" checkbox, in which case the application opens each extracted part after saving it.

A "File Names" section of the dialog allows the user to control the names of extracted parts. The user can specify a string using predefined tokens representing score and part attributes and other data to construct filenames for each part (for example where "% d"=date, "% t"=score title and "% p"=part name, a file name specified as "% d % t % p.sib" may result in a filename of "2004-09-18 Symphony no 1 Violin 1.sib").

The string supplied by the user is also saved with the score, so that parts extracted from the score always use the same format, persisting between sessions.

When you click OK in the Extract Parts dialog, the following Yes/No/Not Again message appears: "You only need to extract parts if you cannot edit them properly without affecting the original score. You should edit a part as much as possible before extracting it. Do you want to go ahead?"

The Multiple Part Appearance Dialog

The Multiple Part Appearance dialog is used to change many aspects of the appearance of the selected Virtual Part(s), including page and staff size, layout, headers and other text, etc.

The Multiple Part Appearance dialog is a tabbed dialog with three pages, "Document Setup", "Layout" and "House Style". When the user launches the dialog, a Yes/No message box appears: "Do you want to change the appearance of all the parts, not just the selected ones?" Clicking No just edits the selected parts. Alternatively two buttons may be provided in the Virtual Parts window: one to edit only the selected parts and one to edit all parts.

When the user has selected multiple parts, all the dialog options should reflect the state of all selected parts. For example, checkboxes are on if all parts have the option switched on, off if all parts have the option switched off, or showing a blob in the middle if some have the option switched on and others have it switched off. If the user makes a change, the checkbox will either go on (all parts on) or off (all parts off). Combo boxes show a value if all the parts have the combo box set to the same value, or show nothing if the option differs between different parts. Choosing another option from the combo box sets the option the same in all selected parts. Edit controls show a value if all the parts share the same value, or show nothing if the value differs between different parts. Typing another value into the edit control sets the value to be identical in all selected parts. Radio buttons show one button selected if all the parts share the same value. If the selected parts have different settings for this option, the radio button will be blank. Choosing one of the radio buttons sets the value to be identical in all selected parts.

"Cancel" and "OK" buttons are provided in the dialog and apply to all pages of the dialog (they belong to the parent dialog, not the child sheets). Cancel closes the dialog, disregarding the changes made on all pages of the dialog. OK closes the dialog, applying the changes made on all pages of the dialog.

A "Set as Defaults for New Parts" button is provided and always enabled. The user can click the button to save all the settings in the Multiple Part Appearance dialog that are in a determined state (i.e. those controls which show actual values, rather than being in the third, non-determined state) to the score. If the button is clicked, the application pops up a Yes/No/Cancel message box with the following message: "Do you want to use these settings as your defaults for new parts? (Any previous defaults will be lost.)". If the user clicks Yes, the chosen settings are added to the score (and hence dirty it). If the user clicks No, the user is returned to the dialog and the settings are not saved. If the user clicks Cancel, the dialog is dismissed and nothing happens.

If the user needs to transfer these settings from one score to another, he can do so via the import/export of house styles in the score (not the parts, since these options are used by the score when creating parts). The House Style>Import House Style dialog has a new Default part appearance checkbox that determines whether or not these settings are imported.

The "Document setup" page of the dialog may, for example, include the following inputs:

- A "Page size" input allows the user to change the page size of the part(s) if desired, or leave them the same as the score (by choosing a "Same as score" option). A combo box contains the standard list of page sizes. If the user hasn't created any defaults, then the combo box may default to either A4 or Letter. The page size chosen here overrides the page size specified by the chosen house style.
- A "Staff size" input allows the user to change the staff size of the part(s), or leave them the same as the score (by choosing "Same as score"). Separate edit controls for mm and inches are provided because not all users will understand a single measurement. When the user tabs away from one of these edit controls, the other will update with the correct value. The staff size chosen here overrides the staff size specified by the chosen house style.
- An "Orientation" input allows the user to choose whether the part should be portrait or landscape, or left the same as the score (by choosing "Same as score"). If the user hasn't created any defaults, this option is set to Portrait by default. The orientation chosen here overrides the orientation specified by the chosen house style.
- Page setup launches a Page Setup dialog. This button is required so that the user can set up the printer settings for the part(s). By default, the application should set the paper size for the printer to be the same as the page size chosen in the Multiple Part Appearance dialog, but the user can click the button to override this if necessary.

For the "Page size" and "Staff size" controls, the values are preferably always independent in parts, just as spacings are preferably always independent in parts. So if the user chooses "Same as score" for either "Page size" or "Staff size", this does not remove the part's independent value: instead, it simply sets the part's value to be the same as the score's current value. If, for example, the score is A3 and a part is A4, if the user then changes the score to be on A4, the Multiple Part Appearance dialog will show "Same as score". However, the part's page size is not linked to the score's, so if the user subsequently changes the page size of the score, the Multiple Part Appearance dialog will show A4 again.

Similarly, for staff size, if the score uses a 6 mm staff and the part uses a 7 mm staff, choosing "Same as score" in the Multiple Part Appearance dialog will set the part's staff size to be 6 mm. However, if the user then subsequently changes the staff size in the score, the Multiple Part Appearance dialog will show 6 mm, i.e. the staff size will not update in the part when it is changed by the score.

The "Layout" page of the dialog may, for example, include the following controls.

- An "Auto Layout button" which launches a dialog for configuring automatic layout options
- A set of options titled "Breaks" which are essentially extensions of the auto layout functionality. The state of these options tells the application how to interpret the breaks in the score, but not actually create overrides in the Virtual Parts. A "Keep page breaks" option allows the user to choose whether or not page breaks in the score should appear in Virtual Parts. A "but turn into system breaks" option is also provided which, if switched on, causes the application to reinterpret page breaks in the score as system breaks in the Virtual Part. These two checkboxes are both switched on by default. A "Keep system breaks" option allows the user to choose whether or not system breaks in the score should appear in Virtual Parts and defaults to off (this does not remove the system break in the part: it just tells the application to reinterpret the break as "no break" in the part.) A "Keep other breaks and locks" option allows the user to choose whether or not other formatting (e.g. locked systems, "bars kept together", etc.) should appear in Virtual Parts, and defaults to off. A "Keep gaps before codas (using split systems)" allows the user to choose whether or not bars with a "Gap before bar" parameter set to non-zero values should show the gap in the Virtual Parts, and defaults to off.

A "Justify staves when page is n % full" input allows the user to set a separate staff justification factor for the part(s). Some users prefer to set their parts to 100% justification. If the user hasn't created any defaults, this value should default to 65%.

An "Indent first system by n spaces" input allows the user to specify an indent for the first system of the part(s). This option sets the "Gap before bar "property of the first bar in the part(s) to whatever value is given here. If the user hasn't created any defaults, the edit control is set to 4 spaces. If the user subsequently drags the initial barline, this value updates with the new gap set in the Virtual Part, i.e. it is always read from the Virtual Part(s).

A "Lower first system by n spaces" input allows the user to specify an "absolute drag" for the top system of the part(s), nominally to allow more room at the top of the first page for title, composer, instrument name, etc. information. This option moves the top system of the score by however many spaces are given here. If the user hasn't created any defaults, the edit control is set to 12 spaces. If the user subsequently drags the top system, this value updates with the new distance set in the Virtual Part(s).

An "Appearance" list box allows the user to choose the appearance of multirests in Virtual Parts. If the user hasn't created any defaults, this option defaults to H-bars.

A "Show '1' on bar rests" option allows the user to choose whether the numeral 1 should be printed above single bar rests in the part(s). If the user hasn't created any defaults, this checkbox should be switched off by default.

The "house style" page may include the following controls:

A "Show instrument names on" group of checkboxes allowing the user to choose where the instrument names appear in the part(s): A "First page" option determines that the part should show its part name at the top-left corner of the first page, while a "Subsequent pages" option determines that the part should show its part name in the Header text style on pages after the first page.

A "Show timecode" combo box allows the user to choose whether timecodes should be shown in the part(s); if the user hasn't created any defaults, this combo box defaults to "No timecode".

A "Time signature size" combo box allows the user to choose whether time signatures in the parts should be Normal (the default if the user hasn't created any defaults), Large, or Huge.

An "Edit Text Styles" button simply launches an Edit Text Styles dialog, and leaves the Multiple Part Appearance dialog open. This allows the user to make changes to the size of text for parts. Changes to the text size in the Edit Text Styles dialog are not saved when the user clicks the Set as Defaults for New Parts button, as these are stored independently in the score. Each text style has a separate point size for the score and the parts. For simplicity, the user preferably cannot set a different point size for each part in the score: there are only two values, one used by the score, and one used by all of the parts. Likewise, the user preferably cannot change the font used by a given text style in the parts.

An "Import House Style" button allows the user to import a new house style into the part(s). This can be useful where, as in this implementation, not every part-independent value in the application (e.g. some settings in Engraving Rules, Note Spacing Rule, etc.) is settable via the Multiple Part Appearance dialog. A "Choose . . . " button brings up a dialog listing all the house style files installed on the computer and allows the user to choose one. Importing a house style overrides all of the values in the Multiple Part Appearance dialog, unless the user chooses not to import the Document setup and Engraving Rules element of the house style.

An "Omit clef changes" option allows the user to specify whether clef changes in the score should be removed in the part(s). If the user hasn't created any defaults, this option is switched on by default. This option has a two-button group of radio buttons associated with it, disabled unless "Omit clef changes" is switched on: a "For transposing instruments" option will only exclude clef changes from a part if the part will use another default clef. This is the default option (provided the user hasn't created any defaults); and a "For any instrument" option will exclude any clef change found in a part. These options are preferably retrospective—if the user changes these options, the application preferably iterates over every Virtual Part and re-enables or disables clef changes as necessary.

An "Omit 'No lines (hidden)' staff type changes" option allows the user to exclude any staff type changes in the score to staff types with no staff lines from the part(s). This is useful if the score is a cut-away or "scrapbook" score and the parts need to have a more conventional layout. If the user hasn't created any defaults, this option is switched off by default.

Options for configuring display of bar numbers may also be provided.

Working with Virtual Parts

Preferably, in order to make the user experience as seamless as possible, the user should never have to think about creating Virtual Parts: the application should automatically create them. Therefore, when creating a new score, the application silently creates a default set of Virtual Parts. When opening existing scores, however, the application should not silently create them: instead, the user should click the "New" button in the Virtual Parts window to create them.

When a set of Virtual Parts is created, the application should also check for the presence of some text objects in the score, and if they're not present, create them. The application may also need to set up some defaults for which there are no user-settable options, i.e. things that must always be done in parts that are different from the score.

If the application has to create more than one Virtual Part at any time, a progress bar is displayed (to make it clear that the program hasn't crashed or hung).

Because the act of creating Virtual Parts (particularly in large scores) takes an appreciable amount of time, and because it may not be appropriate for Virtual Parts to exist in all scores (e.g. those from which parts never need to be extracted), the creation of Virtual Parts for existing scores for which none are yet defined may be optional.

To automatically generate a default set of parts, the application has to allocate staves from the score to the new Virtual Parts. Preferably, as a general rule, the application assigns each instrument to its own part, with certain exception rules being applied (for example for vocal instruments, where the user would typically want to extract all the vocal staves in a single "Choir" Virtual Part).

Parts have names that can be displayed in a number of places:

In the Instrument name at top left text style, on the first page of the part

In the Header (after first page) text style, on subsequent pages of the part

In the Virtual Parts window

In the filenames of extracted parts

The part name should preferably be dynamically derived from the staves in each Virtual Part. When a new Virtual Part is created the part name is created as follows:

Take the name of the first staff in the Virtual Part

Strip out any newlines and font changes, except font changes to the music text font (e.g. Opus Text, for things like Clarinet in Bb).

Insert a change back to the default font after each music text font character.

Insert a newline.

Repeat the above steps for the second, third, etc. instrument in the Virtual Part.

Unless the user has edited the part name field after creation of the part, the application should also repeat the above process when the user adds or removes a staff or staves from the Virtual Part using the Edit Virtual Part dialog, when the user changes the order of the staves in the score such that Virtual Parts containing multiple staves are affected, or when the user edits the instrument name of a staff or staves in the Virtual Part.

The main toolbar of the application window preferably provides a combo box for switching between the virtual parts. The first time the user selects a Virtual Part from this list, a new window is opened containing that Virtual Part. When the user selects another Virtual Part, the new part is shown in the same part window, unless an "Open parts in new windows" option is switched on: however, it defaults to off, which means that, normally, the user will only ever have two windows open at once: one for the score, and one for whichever part he is editing at that time. Both the combo box on the toolbar and the Virtual Parts window respect the "Open parts in new windows option", so if the user wants to have multiple part windows open, he must switch on this option: thereafter, choosing a new part from the combo box on the toolbar or double-clicking an item in the list of Virtual Parts will open a new window.

If the user switches "Open parts in new windows" off—so that the application will re-use existing windows for switching between parts—but already has a number of part windows open at that time, the application will simply use the first part view in the list of open windows for further changes of part view. The application may also provide "Next Part", "Previous Part" and "Show part name" menu options or buttons. If the active window is a score window when the user chooses "Next Part", the application should switch to the part window (if open) and show whatever part was in there before: if no part window is open, the application should open a part window containing the first part in the list of parts. Similarly for "Previous Part": this should either switch to the last viewed part in the part window, or the last part in the list of parts.

A further context-sensitive menu option may be provided to enable switching between a part and the score, preferably whilst keeping the selection in view.

For example, the user could be editing a Trumpet part, come to an item of Expression text, realize that this should actually be attached to a different note, so he selects the text item in the part, chooses "Show Full Score", and the application switches to the score window, moving the currently selected item into view (preferably in roughly the same position on the screen as the item was in the part). He moves his item to where he wants it to go, and he then chooses "Show Trumpet Part", which switches back to the part, again keeping the selected item in view. In this example, the text of the switching menu item changes based on context, referencing the score or last-viewed part. When the user is looking at a score and has not yet looked at a part, the menu item will use the part name of the first part in the list of parts. If the score doesn't have any parts at all the menu item should be disabled.

A corresponding toolbar button may also be provided having context-sensitive tool tip text.

When viewing a Virtual Part, the part looks just like any other score: you can navigate around it, play it back, edit it just like you would normally. The document title bar shows the name of the score, appended with the name of the Virtual Part currently being edited. So the document title bar might say "testscore—French Horn 1" (part) or "testscore" (full score).

The score (meaning the file that consists of a score view and an arbitrary number of active Virtual Parts) remains open until the user closes the final window associated with the score. If the user closes the full score window when one or more Virtual Part windows are still open, the application pops up a Yes/No/Not Again message box: "Closing the full score will close any parts you have open. Do you want to continue?" If the user clicks Yes, the score and all the Virtual Parts windows are closed. If the user clicks No, the user is returned to the active score view. This is to reinforce the notion that the full score is the master document and the Virtual Parts are merely views on it.

When the user adds a new staff or staves to an instrument, that staff or staves will automatically be added to those parts in which the staff to which the new staff or staves belong already occurs. For example, if the user has a Flute instrument in one Virtual Part, and then adds a new Flute (b) staff, it will automatically appear in the score and in the Virtual Part. This also recalculates the brackets, braces and barline groupings for the Virtual Part as appropriate. When the user adds one or more new instrument to the score (using the Instruments and Staves dialog), the instrument(s) will be added to the score, a new default Virtual Part will be added containing each new instrument added to the score. When the user deletes an instrument from the score, the instrument will also be deleted from any Virtual Parts in which it is included. If the instrument being deleted is the only instrument in one or more Virtual Parts, those Virtual Parts will be deleted.

If the user selects an object (such as a line, symbol, text item, etc.) in a Virtual Part and nudges its position (by dragging with the mouse or using the arrow keys), the user is preferably never able to change its rhythmic attachment point: he is able to change only the offset of the item (i.e. its X and Y parameters). Furthermore, these edits to the offset of the item do not affect the position of the object in the score.

If, on the other hand, the user selects an object in the score and nudges its position (by dragging with the mouse or using the arrow keys), the object moves in the layout as above; however, if the user moves it sufficiently far, it will reattach to a new rhythmic position. Provided the user has not already adjusted the position of the object in the Virtual Part, the item's position will also be adjusted in the Virtual Part. However, if the user has adjusted the position of the item in the Virtual Part, then the change in the score will not be reflected in the Virtual Part.

However, if an item has an independent position in the Virtual Part and the item is moved to a new rhythmic position in the score, then the item will move in the Virtual Part: its rhythmic position will be changed, but its offset will be retained (i.e. it will not move to the same position as the score: it will move to the new rhythmic position in the score plus the existing offset).

Once an item has been moved in a Virtual Part, it no longer reflects any changes in position made in the score. If the user needs to restore the link between the position of an item in a Virtual Part and the score, he can use a "Reset to Score Position" option or menu item to do so. The user can also reset an item in the Virtual Part to its default position as defined in a "Default Positions" dialog by choosing a "Reset to Default Position" menu item in the "Layout" menu, but this does not restore the link to the score position: it simply changes the independent position in the part. This may or may not be the same as the position in the score (depending on whether the user has modified the position of the item in the score).

Additionally, "Layout>Reset to Score Design" and "Layout>Reset to Default Design" options may be provided. When the user chooses "Reset to Score Position" or "Reset to Score Design" while editing the score, the application will change all Virtual Parts. Because this is potentially quite a destructive edit, the application will pop up a Yes/No/Not Again message box: "This will reset the <position/design> of the selected object(s) in all of your parts. Are you sure you want to continue?" If the user clicks Yes, the reset is applied to all Virtual Parts; if the user clicks No, nothing happens.

When the user moves an item in a part (so that it has an independent part position, i.e. it is no longer linked to the position of the item in the score), the item is preferably drawn in a different color to highlight the fact that the item position is now independent of the score, and its attachment line is also drawn in the same color. This makes it clear to the user that although he can drag the item around wherever he likes in the part, he cannot change its attachment.

This coloring is controlled by a "Part Positions" provided in the "View" menu. The option can be set independently for part views and score views. The option defaults to on for part views, and off for score views. Additionally, "View>Attachment Lines" will also default to on for both part and score views, but can be enabled and disabled independently in score views and part views.

In a score view, "View>Part Positions" when active colors items that have independent positions in at least one part. This gives the user a visual cue about what the effect of options like "Layout>Reset To Score Position" will be.

As soon as a user moves an item in a part for the first time, it and its attachment line change color to let him know that something has happened. Specifically it means the position or existence of this object is different from the score, not that just any of its properties are different. This means:

Items that have independent positions (e.g. text items, lines, rehearsal marks, etc.) are drawn in the part positions color.

Clef changes and staff type changes that are visible in the part only (i.e. they have "null" clef and staff type changes in the score) are drawn in the part positions color to show that they are part-specific.

Layout marks that belong to the individual part are drawn in the part positions color. Only breaks which "show through" from the score are in the normal color. If you override one of these breaks, it is shown in the part positions color. If you remove one of these breaks, a special symbol for "no break" is displayed in the part positions color.

The color applied by View>Part Positions overrides user-defined colors. Selected and unselected items are preferably distinguished using different shades of the relevant color.

To give the user a strong visual cue that dragging an item in a part only ever affects its offset rather than its actual rhythmic position, attachment lines in parts are preferably drawn in red if the user drags a staff item more than 4 spaces horizontally or 8 spaces vertically from its original (or alternatively default) position. "View>Attachment Lines" is switched on in parts by default.

Because the Virtual Parts window is intended for advanced users, the average user should be provided with a way of printing all the Virtual Parts without going into the window. The answer is to add a new File>Print Virtual Parts menu item. When the user chooses Print Virtual Parts, the standard Print dialog appears with the same behavior as when called from the Virtual Parts window, with all the parts selected.

The display of staves in Virtual Parts may be automatically adjusted as follows. If a staff has the "Small" property set in the score, it will be made large automatically in its Virtual Part(s). If the user wants the staff to be small in the Virtual Part(s), he can explicitly change it to "small" in the affected part(s)

The user can also create staff and system objects in Virtual Parts. Depending on the kind of object being created, it may be useful for the vertical position of objects in a Virtual Part to be linked to their vertical position in the score. For each type of object, the application behaves as follows:

Text:

All staff text is created with a link between the score and the Virtual Part(s).

Bar-attached system text (Tempo, Metronome marks, Repeat (D.C./D.S./To Coda), etc.) is created unlinked, i.e. the vertical position in the Virtual Part is independent from the position in the score by default. This is because, unlike staff text (which should be linked by default) system text is almost always more usefully placed at the default position in the part than being linked to the score position, because the decisions taken by the user to move objects in the score rarely apply to the parts.

Page-attached system text (Title, Subtitle, Dedication, Copyright, Composer, Lyricist, Header, Footer) is created linked, i.e. the vertical position in the Virtual Part is linked to the position in the score by default.

Lines:

All staff lines are created with a link between the score and the Virtual Part(s).

All system lines (e.g. rit./accel. lines, 1st and 2nd endings, etc.) are created unlinked Symbols:

All staff symbols are created with a link between the score and the Virtual Part(s).

All system symbols (e.g. coda, segno, conductor symbols, etc.) are created unlinked Rehearsal marks are created unlinked, i.e. the vertical position in the Virtual Part is independent from the position in the score. Where bar numbers appear, they are unlinked in the Virtual Part, i.e. if the user drags a bar number in the score, that drag will not be reflected in the Virtual Part.

If a user needs to "re-link" the position of a text object in a Virtual Part to the position in the score, he can choose "Layout>Reset To Score Position" (the user can also do this to an object in the score, which re-links the position of the object in all Virtual Parts.)

Layout and spacing information in Virtual Parts is preferably independent, but the layout of a Virtual Part is actually influenced by both the layout of the score (hence the options on the Layout page of the Multiple Part Appearance dialog) and the settings chosen in the Layout>Auto Layout dialog. This means that Virtual Parts include "dynamic" layout information that changes based on changes to these options.

If the user creates an explicit break in a Virtual Part, then its icon is shown in the same color as used by View>Virtual Part Positions. If the user wants to restore the link to the layout of the score, he switches on all of the checkboxes under Breaks on the Layout page of the Multiple Part Appearance dialog (see above).

An "Unlock Format" menu item is provided which removes any breaks that are only in the part, and remove any breaks that are "showing through" from the score. The latter will appear as a new "no break" symbol drawn in the disconnected color (the same as when a system break shows through from the score into the part, and you then remove it in the part). The "no break" break should only be used where necessary, i.e. where there actually is a break in the score.

Items that can be flipped (slurs, stems, beams)—i.e. changed between being displayed above or below the notes—can be flipped independently in the part and the score. If you flip a note in the score, it will be flipped in the Virtual Part, provided it does not have an independent flip value set. But if you flip it in the Virtual Part, flipping it in the score will not flip it in the Virtual Part (because the part now has an independent value).

The user can select items in either the score or part views. Selections affect both the score and the Virtual Parts. So if you make a passage selection that spans multiple staves in the score, all the Virtual Parts that contain one or more of these staves reflect the selection. If you select, say, the violin 1, violin 2 and viola staves in the score, and have the Virtual Parts for these staves open at the same time, you will see that each of the three Virtual Parts show the same selection.

However, the operations that you do when you have something selected may or may not affect both score and Virtual Parts. For example:

- Resetting note spacing in a Virtual Part just affects the Virtual Part, not the score
- Selecting "Reset Position" in the score resets the position of the items in the selection in the score, and will reset the position of items in the Virtual Part(s), if the positions have not been overridden in the relevant Virtual Part(s).
- Transpose the selection will affect both the score and the Virtual Part(s).
- Deleting the selection will affect both the score and the Virtual Part(s).

The creating of music objects generally affects both the score and the Virtual Part(s). An exception is the creation of brackets and braces. Because brackets and braces are stored independently in Virtual Parts (and are created based on the bracketing and bracing in the score at the time of the part's creation), it is possible to create brackets and braces in Virtual Parts that have no effect in the score. Likewise, changes to brackets and braces in the score after creating Virtual Parts have no effect on those Virtual Parts.

Playback commands may be provided, which affect the current view: if you play back a Virtual Part, you hear only the staves in that part.

Timecodes may be displayed in both the score view and part views. The display of timecodes can be configured separately for the score and parts.

Example Implementation—Media Synchronization

An exemplary implementation of a music editing application incorporating "Media synchronization" functionality as described above will now be described, again with particular focus on user interface features of such an application. This may of course be combined with the example implementation of the "Virtual parts" functionality as described above.

The aim of this example implementation is to at least provide a sufficient level of digital video support to allow basic "composing to picture," for example for education projects that combine digital video and music, though the functionality will also be useable for other applications.

To this end, the application provides the ability to associate a digital video file with a score, in whichever formats are supported by the codecs on the host machine, to maintain synchronization between playback of the score and playback of the video file, and to create "hit point" objects in the score that correspond to particular actions or events in the video, to help users align events in the video with points in the music.

Working with Video Files

Video support may for example be via the Apple QuickTime API on MacOS or the Microsoft DirectShow API (part of DirectX) on Microsoft Windows, preferably using MPEG2 codecs.

To add a video file to a score, the application preferably provides an "Add Video" menu item that launches a system "file open" dialog, allowing the user to choose a video file for association with a score. The path to the video file and the name of the video file are stored in the score.

A "Remove Video" menu item may also be provided for removing a previously added video file.

Once a video file is attached to a score, the user may choose a "Window>Video" menu item to open a floating window in which the video will be displayed. The video window may, for example, provide the following controls:

- "Hit" button: this button adds a hit point at the point of the selected frame in the video. (Use case: a user will attach a video, add lots of bars to his score, then play the score, hitting the "Hit" button each time an event in the video occurs that he feels needs to be accentuated by the music.)
- Window size buttons: four buttons for half size, normal size, double size and full screen are provided. (Use case: a user can attach a video and play back the score in "full screen" mode. Alternatively, a user can drag the video window to a second display, click the "full screen" button, then play back the score on one display and the video on the other.)
- Volume: a slider controlling the volume level of the video.

Video transport controls could also be provided in the window; however, video playback is preferably under control of the general score playback controls provided by the application. The Video window title bar shows: "Video" when no video is attached, or "Filename (codec)" when a video is attached. The Video window can be shown or hidden whenever a score is open, regardless of whether a video has been attached. If no video is attached, the window appears with a graphic informing the user that no video has been loaded. If the Video window is hidden when a video is attached, the soundtrack of the video (if any) is preferably still played back.

Synchronization During Playback

Playback of the score is synchronized with playback of the video. This means:

When the user starts playback, the video starts playing from the same position as the score.

If the user adjusts the tempo slider during playback, the video will adjust its speed as best it can. (Some video formats support this functionality better than others: if the video codec doesn't support this functionality, then things will look a bit weird and the video will resynchronize at the start of the next bar.)

If the user fast-forwards or rewinds the score, the video will synchronize at least once a bar, so when the user releases the fast-forward/rewind button the video will re-synchronize.

Synchronization When Not Playing Back

It is also useful to maintain the synchronization of the score and the video when the score is not playing back, so that the user can shuttle through the video file and see where a particular frame corresponds to a position in the score.

This need is met by the display of a playback position indicator that appears in the score at all times. The position of the playback indicator is in sync with the position of the video. The timecode of the current playback position, as indicated by the playback indicator, is preferably also displayed.

Different Start Times for Video and Score

Because of the characteristics of the wide variety of video files—from home movies to cuts from a larger film—it is useful to be able to control aspects of when exactly the video starts compared to the score, exactly where within the video the playback starts, and to control the relationship between the start time of the video and the start time of the score. A "Timecode and Duration" dialog is provided to enable this to be configured, which may include the following controls:

A "Timecode of first bar" input is used to set the value of the timecode at the start of the score (by default 0).

To allow the video to start at a different time to the score, a "Start video at" control is provided, allowing the user to select a "Start of score" option, in which case the video starts at the same time as the score, or to specify the required video start time (e.g. to start the video 1 minute into the score).

If the user needs to start from somewhere other than the first frame of the video, he can edit a "Start video from" input to start from any point in the video clip. For example, to start from 2 minutes into the video, the user would enter "2'00" into this field.

The edit controls are all able to understand a variety of time formats, for example "1'00", "00:01:00:00", "1:00', all of which specify one minute. The dialog may allow the preferred timecode format to be selected.

No special behavior is required if the video is longer than the score, or if the score is longer than the video: if the video is longer than the score, it will simply stop playing when the score stops playing; if the score is longer than the video, the video will stop at its final frame and the score will continue playing.

Hit Points

In order to compose to picture effectively, the composer needs a way of matching particular events in the video to musical events. This is achieved through "hit points," which are text labels that appear at fixed timecode positions.

This means that as the user changes the score—adds tempo markings, fermatas, deletes bars, adds rit./accel. lines, etc.—the hit point will move through the score.

A hit point is displayed as a boxed text item consisting of:

Its timecode position, in whatever format is chosen in the Timecode and Duration dialog.

Its beat position, in the format bar.beat.tick, e.g. (1.4.256).

A text label, chosen by the user, which typically describes the action at that moment in the video.

Hit points snap to the nearest beat, and are drawn above the top staff of the score. The height of hit point objects above the staff can preferably be be adjusted by the user.

Hit points can be created in two ways: via the "Hit Points" dialog (see below); or by clicking the "Hit" button in the Video window, either while the score is playing back, or while the score is paused.

Preferably, within the score, hit points cannot be selected, dragged, or edited in place (as this would change the attachment of the hit point to a given frame of video—the hit point is always displayed in the score at its real time position as dictated by the video). Instead, a hit point—either its label or position—can be changed using the "Hit Points" dialog.

The "Hit Points" dialog lists the hit points in the current score including:

A "Time" column which shows the time position of the hit point. To change the time position of an existing hit point, double-click the time and edit it.

A "Bar.beat.tick" column which shows the location of the hit point in the format bar.beat.tick. This field preferably can't be edited by the user, but it updates when the time is changed.

A "Name" column is the text label for the hit point. By default, hit points are created with the label "Hit n", where n is a sequentially-increasing integer, e.g. 01, 02, 03. To change the label, the user double-clicks the label and types a new one.

Additionally, the following controls may be provided:

A "New" button adds a new hit point to the list view, at a "zero" timecode position, ready for the user to edit its time and name.

A "Delete" button allows the user to delete the selected hit point.

A "Delete All" button deletes all the hit points in the score.

A "Shift All" button allows the user to shift the time position of all hit points in the score by a uniform amount, e.g. to add 10 seconds to the time position of all hit points.

If the user needs to see the timecode position of a selected object, the user can select the object, and use the "Move Playback Line to Selection" command to move the playback indicator to the selected object (as the timecode for the playback indicator is always displayed).

In addition to the hit point timecode objects, regular timecodes may also be displayed with the score. The display frequency and position of timecodes is configured in the "Timecode and Duration" dialog. Examples of options may include: "Above every bar", "At start of every system", and "None" in which case no timecodes are displayed. The user can preferably also choose whether a timecode should be drawn above the very first bar. The user may not want this if, for example, the score has a title page.

A video will likely have its own audio track with dialogue and other sounds. The audio from playback of the video and score is preferably mixed, with the user able to set the balance between the two. The balance setting (essentially the volume of the video audio track) is preferably saved along with the video file name in the score.

Timecodes should be displayed/interpreted with respect to whatever timecode format is chosen in application settings. If this changes, the display of a timecode associated with a timecode object also changes. This implies that the timecode stored in a timecode object should preferably have a resolution fine-grained enough to support conversion between the timecode formats (preferably storing at least milliseconds).

It will be understood that the present invention has been described above purely by way of example, and modification of detail can be made within the scope of the invention.

The invention claimed is:

1. A method of synchronizing a musical score with a source of time-based information, comprising:

deriving a mapping between rhythmic positions in the musical score and a reference time base according to one or more specified tempos; and synchronizing playback of the musical score with playback of the time-based information using the derived mapping.

2. A method according to claim 1, wherein the mapping maps tempo changes in the musical score to the reference time base.

3. A method according to claim 1, wherein the reference time base comprises real-time timecodes.

4. A method according to claim 1, wherein deriving a mapping comprises generating a table mapping rhythmic positions to timecodes.

5. A method according to claim 4, wherein the table comprises entries representing tempo changes in the musical score, each entry specifying the rhythmic position at which the tempo change occurs and the corresponding timecode.

6. A method according to claim 5, wherein each entry further specifies the tempo applicable after the corresponding tempo change.

7. A method according to claim 6, comprising using the mapping to map between rhythmic positions and timecodes.

8. A method according to claim 7, comprising, for a given timecode or rhythmic position having an entry in the table, performing the mapping using the entry.

9. A method according to claim 7, comprising, for a given timecode or rhythmic position not having an entry in the table, identifying the immediately temporally preceding entry in the table by reference to the thnecodes or rhythmic positions specified in the table, and calculating a rhythmic position or timecode corresponding to the given timecode or rhythmic position using the timecode or rhythmic position of the preceding entry and the tempo specified by the preceding entry.

10. A method according to claim 1, wherein the rhythmic positions associated with the score are playback time positions relating to the rhythmic time positions at which music elements are played, the method further comprising determining a mapping between notational time positions relating to the rhythmic time positions at which music elements appear in the notation of the score, and playback time positions, and using said mapping in combination with the mapping between playback time positions and a reference time base to provide a mapping between notational time positions and the reference time base.

11. A method according to claim 10, wherein determining the mapping comprises determining the playback order of elements of the score.

12. A method according to claim 10, wherein determining the mapping comprises determining the order of playback of bars in the score, and generating a table listing the playback time positions for each bar in the order played.

13. A method of synchronizing a musical score with a source of time-based information, comprising:

deriving a mapping between rhythmic positions in the musical score and a reference time base according to one or more specified tempos; and synchronizing the musical score with the time-based information using the derived mapping, wherein synchronizing comprises displaying a playback position indicator in the score corresponding to a current time position of the time-based information source.

14. A method according to claim 1, wherein the time-based data source comprises media data, and wherein synchronizing the score with the time-based data source comprises performing synchronous playback of the media data and the score.

15. A method according to claim 14, comprising receiving an indication of an event occurring at a given time in the media data and generating a corresponding event marker for display in the score at the corresponding rhythmic position as determined using the mapping.

16. A method according to claim 15, wherein the media data comprises video data.

17. A music notation computer program product, comprising:

a computer readable medium, and computer program instructions stored on the computer readable medium that, when executed by a processor define a music notation editing application, comprising:

a user interface for displaying and editing a musical score;

a score playback component for playing back the score;

a video playback component for playing a video source; and a synchronization component for synchronizing the score and the video source according to a mapping derived between rhythmic positions in the musical score and a reference time base according to one or more specified tempos.

18. A computer program product according to claim 17, wherein the synchronization component is adapted to display a playback position indicator in the score at a score position corresponding to a current playback position of the video source.

19. A computer program product according to claim 17, wherein the synchronization component is adapted to synchronize playback of the video source with playback of the score.

20. A computer program product according to claim 17, wherein the synchronization component is adapted to display an event marker identifying an event or frame in the video source at a corresponding time position in the score.

21. A computer program product according to claim 20, wherein the video playback component comprises an interface element for creating an event marker at a currently displayed frame of the video.

22. A computer program product according to claim 20, wherein the event marker is displayed with on or more of a time code, a name, and a rhythmic position.

23. A computer program product according to claim 17, wherein the user interface is adapted to display time codes with the score, the time codes specifying the playback time for given rhythmic positions in the score.

24. A computer program product according to claim 17, wherein the synchronization component comprises a mapping component adapted to derive a mapping between rhythmic positions in the score and time codes.

25. A computer program product according to claim 24, wherein the mapping is usable to map between rhythmic positions and video time codes or frames.

26. A media playback system for performing synchronous playback of a musical score with a video source, comprising:

a processing component adapted to derive a mapping between rhythmic positions associated with the musical score and a reference time base according to one or more specified tempos; and a playback component adapted to synchronously play the score and video source using the derived mapping.

27. A media playback system according to claim 26, further comprising an input component for setting a desired start time in the score at which the video playback should begin and/or a desired video position in the video source at which playback of the video source should begin, the playback component being adapted to synchronously play the score and video source in accordance with the start time and/or video position set.

* * * * *